United States Patent [19]

Roman

[11] 4,229,001

[45] Oct. 21, 1980

[54] THERAPEUTIC EXERCISE DEVICE

[76] Inventor: Michael P. Roman, 1969 Virginia La., Norristown, Pa. 19401

[21] Appl. No.: 15,522

[22] Filed: Feb. 23, 1979

[51] Int. Cl.[3] ..... A63B 23/04; A63B 21/04

[52] U.S. Cl. ..... 272/96; 272/131; 272/142; 272/DIG. 3; 272/DIG. 4; 272/DIG. 5

[58] Field of Search ..... 272/96, 97, 93, 94, 272/127, 131, 141, 142, DIG. 3, DIG. 4, DIG. 5, 146; 128/25 R, 25 B

[56] References Cited

U.S. PATENT DOCUMENTS

| | | | |
|---|---|---|---|
| 1,521,487 | 12/1924 | Turner | 272/127 |
| 2,387,966 | 10/1945 | Zander | 272/116 |
| 2,408,597 | 10/1946 | Belling | 272/127 |
| 2,689,127 | 9/1954 | Silverton | 272/134 X |
| 4,149,713 | 4/1979 | McLeod | 272/134 X |

FOREIGN PATENT DOCUMENTS

| | | | |
|---|---|---|---|
| 2015054 | 10/1971 | Fed. Rep. of Germany | 128/25 R |

*Primary Examiner*—George J. Marlo
*Attorney, Agent, or Firm*—Beveridge, DeGrandi, Kline & Lunsford

[57] ABSTRACT

A patient's lower leg and foot are received by a "boot" which is movable to guide and control the performance of various exercising functions. The sole of the boot is pivoted relative to the leg-receiving portions for soleus pumping exercises, and the entire boot is supported for vertical and horizontal pivoting movement on a longitudinally guided carriage which permits both longitudinal and transverse horizontal boot movement for knee bending and hip exercises.

20 Claims, 10 Drawing Figures

FIG. 3
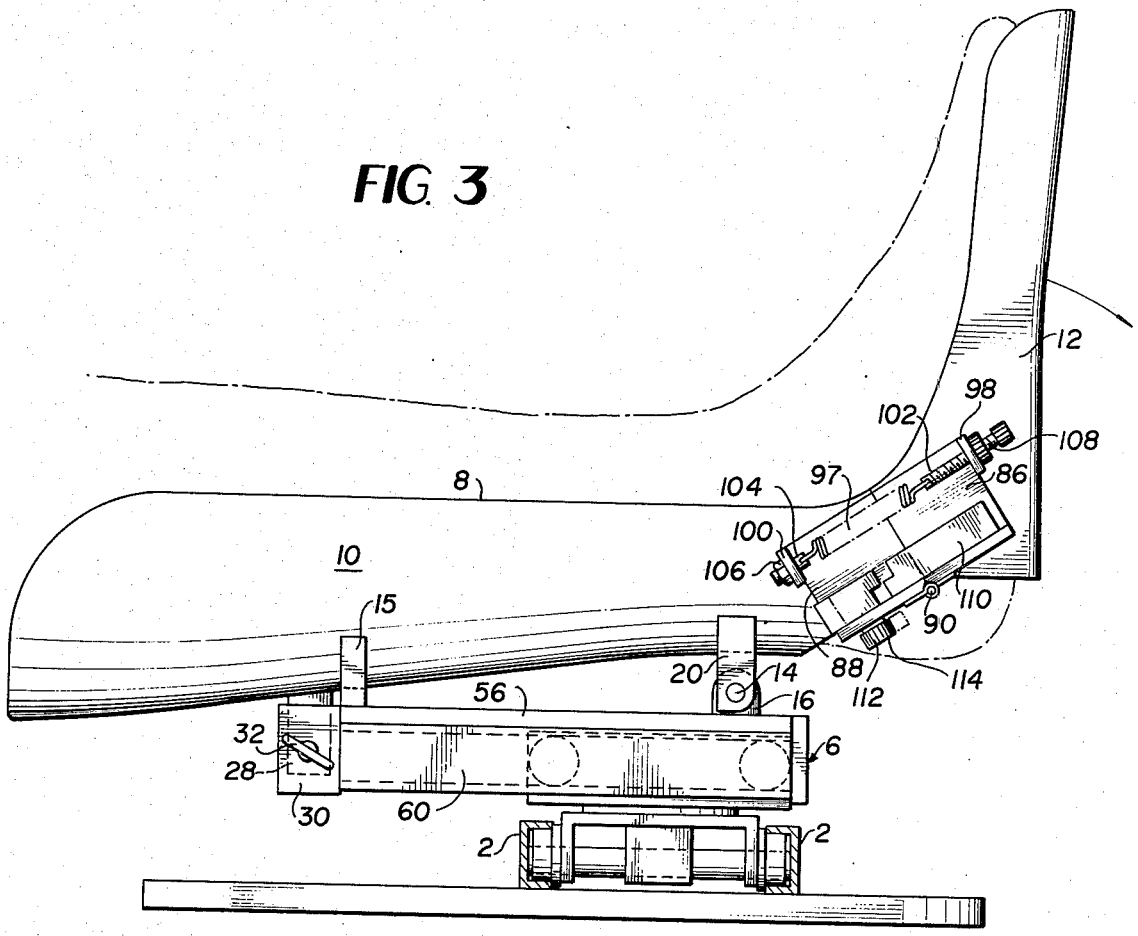
FIG. 4
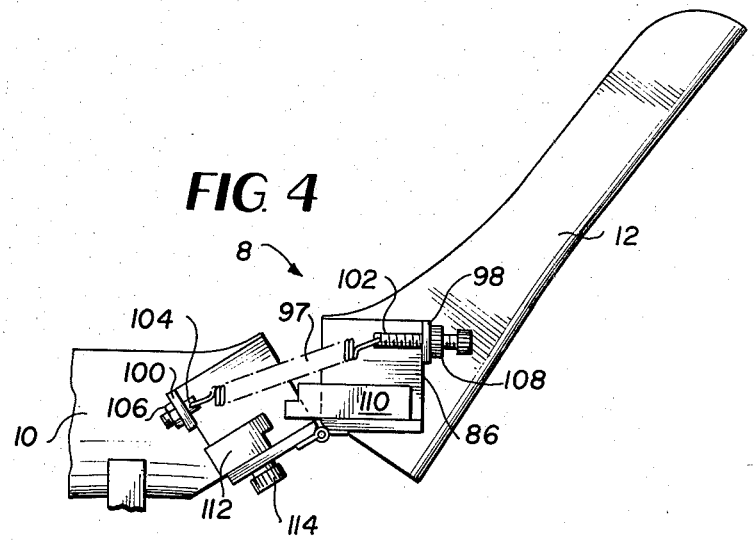
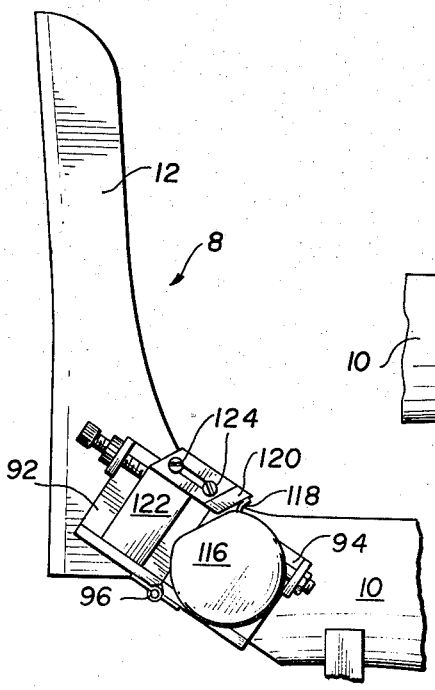
FIG. 5

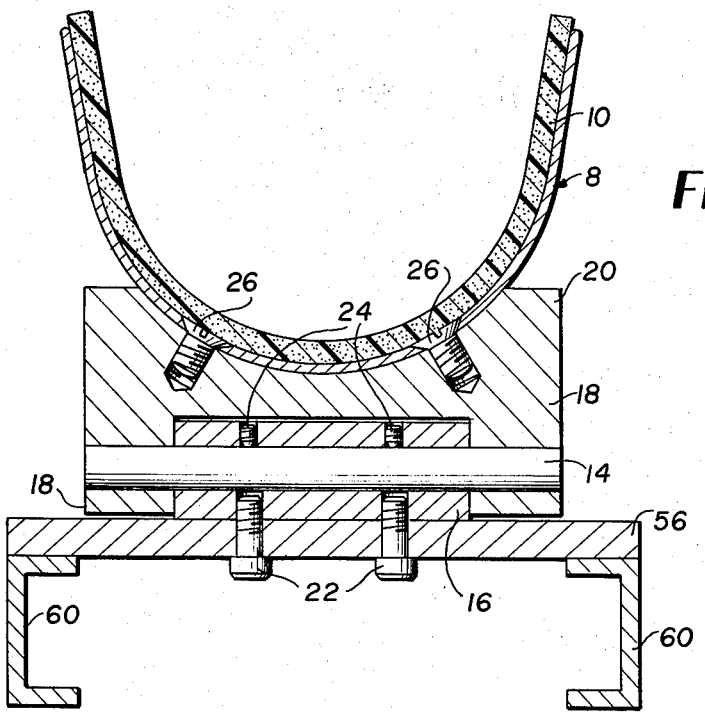
FIG. 8
FIG. 9
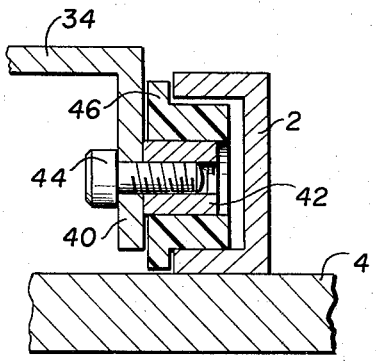
FIG. 10
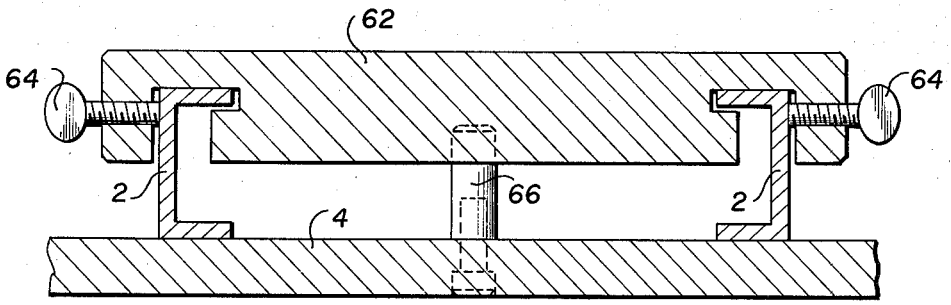

THERAPEUTIC EXERCISE DEVICE

REFERENCE TO DISCLOSURE DOCUMENT

This invention is disclosed in Disclosure Document No. 1575-77, filed in the U.S. Patent and Trademark Office on Mar. 28, 1978, the content of which is incorporated herein by reference.

BACKGROUND

This invention relates to an exercising apparatus useful for administrating physical therapy to patients who have various physical afflictions or are recovering from surgery. It is primarily applicable to patients having a need to strengthen the hip, knee or ankle joints. The apparatus of the invention may be used in a hospital for treating patients who have had hip or knee surgery, in a nursing home where aged residents may benefit from the exercises provided, and in private homes where arthritic patients or those recovering from surgery or may benefit from specified exercises.

It is a well-accepted medical principle that many afflictions resulting from increased age, arthritis and surgery are improved by physical exercise. In recognition of this broad principle, the prior art is replete with physical exercising devices which enable a patient to exercise the specific areas of the body, the following patents disclosing a typical but inexhaustive collection of such devices, U.S. Pat. Nos.:

1,531,670 Levy
1,948,534 Nelson et al.
2,340,666 Johanson
2,408,597 Belling
2,455,274 Scriver
2,689,127 Silverton et al.
2,763,261 Masmonteil et al.
3,020,046 Hotas
3,374,675 Keropian
3,421,760 Freeman, Jr.
3,467,374 Auer
3,524,643 Hazelitt, Sr.
3,526,220 Small et al.
3,568,666 Dunn
3,580,244 Graves
3,598,405 Burns
3,612,042 Fry
3,661,149 Ferries
3,749,400 Stoffel
3,797,824 Osbourne
3,917,261 Small et al.
4,089,330 Nicolosi et al.

The Ferries U.S. Pat. No. 3,661,149 describes an exercising device which may be used to swing the foot from side-to-side and to pivot the foot on its ankle to stretch the heel cords. A longitudinally adjustable leg rest is not moved during exercises, so knee bending is not contemplated.

Exercising devices which enable a patient to move his ankle are well-known and exemplified by the Small et al. U.S. Pat. No. 3,917,261. Knee exercising devices are shown, for example, by Stoffel U.S. Pat. No. 3,749,400; and, leg-swinging hip exercising devices are known and exemplified by Belling U.S. Pat. No. 2,408,597. There are also many general purpose exercisers capable of use for exercising a variety of joints and limbs, two such general purpose devices being described by the Keropian U.S. Pat. No. 3,374,675 and Nicolosi et al. U.S. Pat. No. 4,089,330.

SUMMARY

The present invention provides a compact and simple therapeutic exercising device which is highly versatile in the sense that it may be used in connection with a variety of exercises, primarily but not exclusively concerned with the lower extremities, i.e. the foot and lower leg.

According to the invention, a therapeutic exercising apparatus is provided with a boot assembly supported by a carriage assembly which is engaged with and guided by an elongated guide means. The boot assembly is movable in a substantially horizontal linear path and in a substantially horizontal arcuate path, the former being useful during knee bending exercises and the latter being useful for hip abduction and adduction exercises. The boot includes a leg receiving member and a sole member which is pivotally movable relative to the leg-receiving member; or the boot assembly is tiltable about a horizontal pivot axis to permit knee flexion and extension exercises during movement of the carriage. Preferably, pivot means enable the boot assembly to swing horizontally about a substantially vertical axis, and stop means are provided to hold the boot assembly at a desired position along its arcuate path to hold the hip at a desired degree of abduction. Means may be provided for locking the boot against such tilting action, and for exerting a resistance force on the carriage to resist but not prevent its movement along the guide means. The boot itself preferably has a resistance spring which biases the sole member to an upright position which is oriented at about 90° to the leg-receiving member, this spring serving to exert a force on the sole member which resists but does not prevent movement of the sole member relative to the leg-receiving member. Disengageable lock means are provided to prevent pivotal movement of the sole member relative to the leg-receiving member for certain exercises.

The invention may take many forms, so it is to be understood that the following description is for purposes of exemplification rather than limitation.

DESCRIPTION OF THE DRAWINGS

FIG. 3 is an elevational view of the device when being used for hip abduction and adduction exercises.

FIG. 4 is a fragmentary view corresponding in part to FIG. 3 but showing the apparatus in use for soleus pumping exercises.

FIG. 5 is a fragmentary elevational view showing the left side of the lower portion of the boot assembly.

FIG. 8 is a sectional view of the upper carriage portion and boot assembly as seen along the line 8—8 of FIG. 6.

FIG. 9 is a sectional view showing the wheel mounting structure seen along the line 9—9 in FIG. 6.

FIG. 10 is a sectional view showing the relationship between the guide rails and the movable stop member associated therewith.

DESCRIPTION OF THE PREFERRED EMBODIMENT

Figure 1:
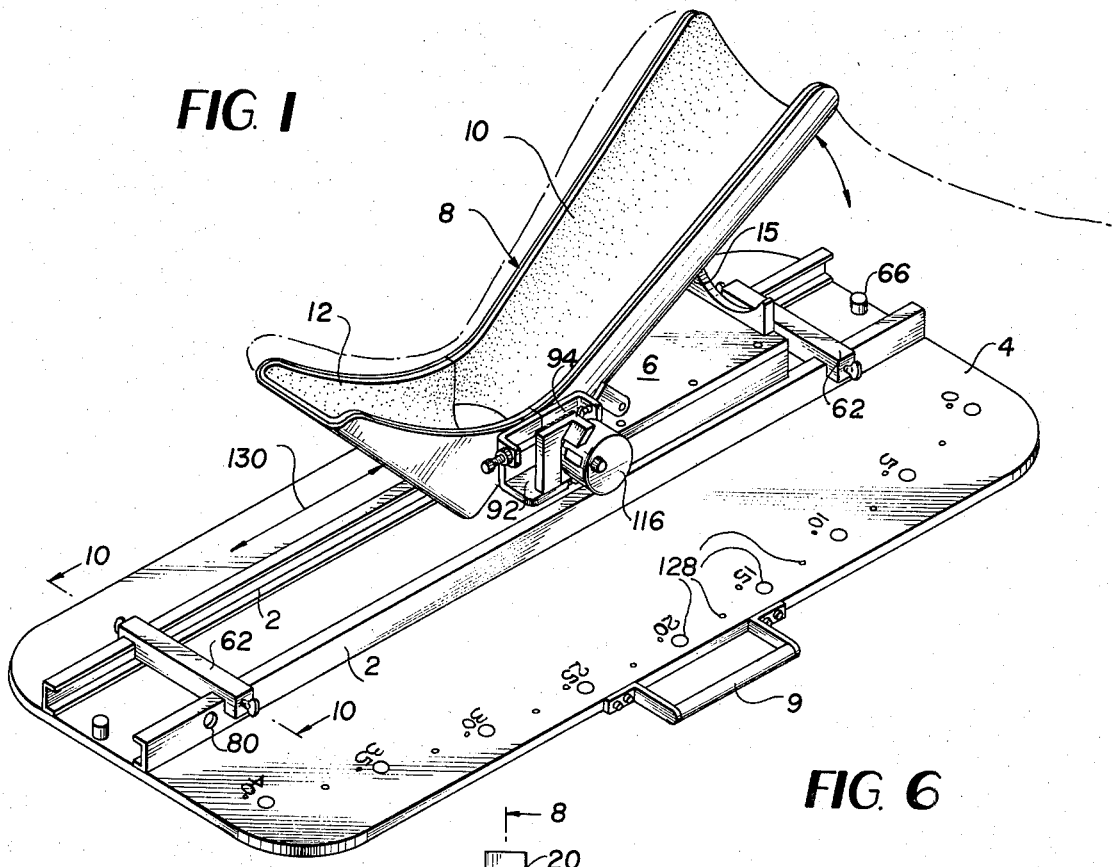
FIG. 1 is a perspective view of the preferred apparatus, as it appears when performing knee bending exercises.

The apparatus includes a pair of parallel guide members 2 connected to a base plate 4, a carriage assembly 6 which is engaged with and guided by the guide members 2 and a boot assembly 8 which is supported on the carriage to accommodate a patient's lower leg and foot. For convenient handling and portability, the apparatus has a handle 9 attached centrally to a side edge of the base plate 4. The boot assembly 8 is formed of a rigid lightweight shell lined with a softer cushioning material such as platic foam. It includes a leg-receiving member 10 for engaging the lower leg of a patient, and a sole member 12 which engages a patient's sole. The sole member 12 is movable relative to the member 10 about a substantially horizontal pivot axis as will be described below.

The entire boot assembly 8 is tiltable about a substantially horizontal pivot axis and swingable about a substantially vertical pivot axis. Tilting movement of the boot assembly, useful for knee flexion extension exercises, is provided by a pivot pin 14 which connects the boot assembly to the carriage assembly and permits the boot assembly to move from the reclined position shown in FIG. 3 to the tilted or inclined position shown in FIG. 1. While in its reclined position, the boot is supported by cradles 15 and 20 on carriage assembly 6.

The pivot structure which enables the boot 8 to undergo its tilting movement is best shown in FIGS. 3 and 8. The pivot pin 14 extends through aligned bores in a block 16 and in spaced depending projections 18 of a pivoting boot cradle 20. The block 16 is attached to the carriage 6 by bolts 22, and it has set screws 24 for holding the pin 14 in position. The boot cradle 20 is attached to the leg portion 10 of the boot by a pair of screws 26.

Figure 2:
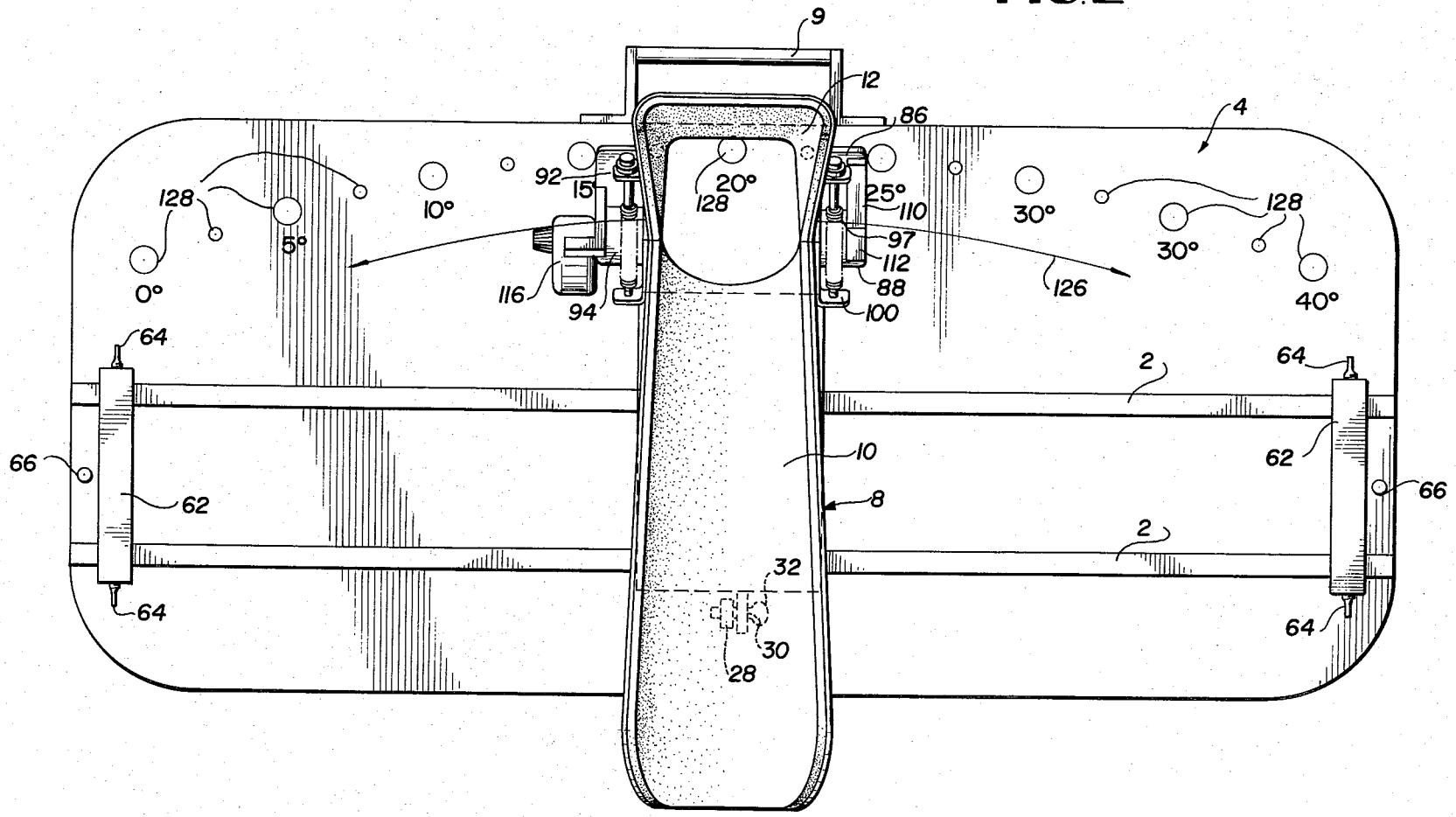
FIG. 2 is a plan view of the apparatus when being used for hip abduction and adduction exercises.

For exercises when pivotal movement about pin 14 is unneeded or undesirable, the boot 8 may be locked in its reclined position by a disengageable lock means which is seen in FIGS. 2 and 3. It includes an eye bolt 28 which depends from boot 8 and is disengageably secured to a bracket 30 on the carriage 6 by a thumb screw 32. The bracket 30 has a threaded opening for the thumb screw 32, enabling the thumb screw to be rotated to move from an extended position where it projects through the eye 28 to a retracted position where it is withdrawn from the eye 28. When the thumb screw 32 is in its extended position, the boot assembly is held against pivotal movement about the pin 14. When such pivotal movement is desired, the thumb screw is rotated until it reaches its retracted position whereupon the boot assembly is free to swing vertically about the pin 14.

Figure 6:
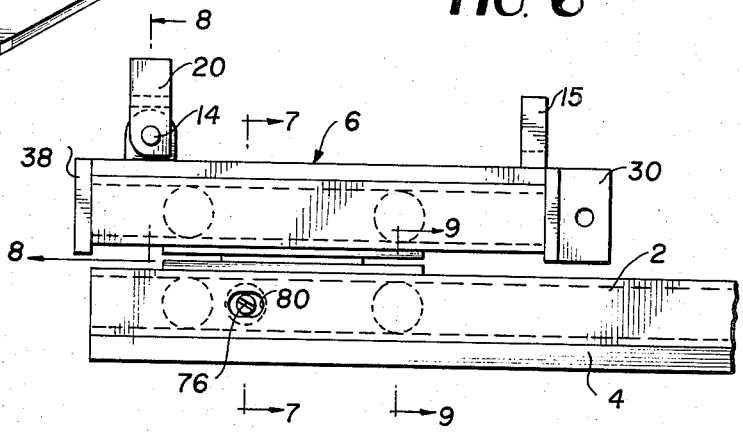
FIG. 6 is a side elevation of the base plate, guide track and carriage, the latter being located in a position where drag adjustments are made.
Figure 7:
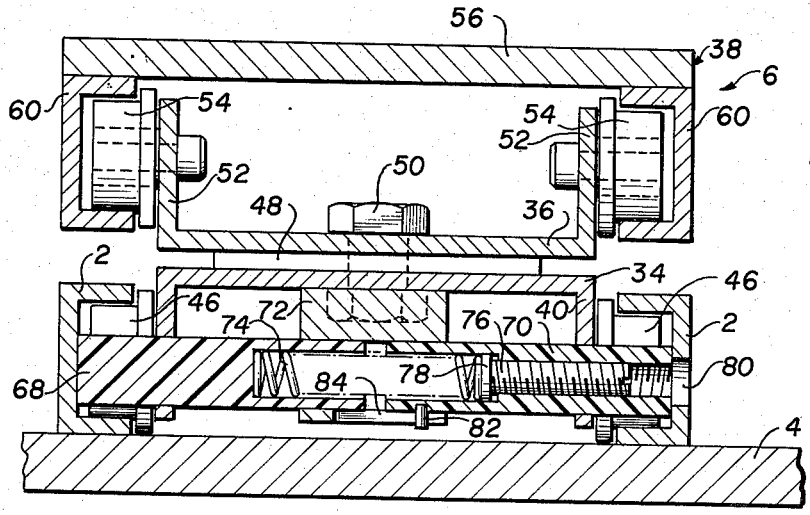
FIG. 7 is a sectional view of the carriage as seen along the line 7—7 in FIG. 6.

The boot assembly 8 is able to swing horizontally about a vertical pivot axis. It is also able to move in a substantially horizontal arcuate path or in a substantially horizontal linear path parallel to the guide members 2. This mobility is preferably provided by constructing the carriage assembly 6 as shown in FIGS. 6, 7 and 9. This assembly includes a lower carriage portion 34 which is horizontally movable, an intermediate carriage portion 36 which is supported by and pivoted on the lower carriage portion 34, and an upper carriage portion 38 which is supported on the intermediate carriage portion 36 and is movable thereon in a horizontal linear path.

The structure of the lower carriage portion 34 is best seen in FIG. 7. It includes a channel of inverted U-shaped cross section. This channel has depending flanges 40 which support four wheels. As shown in FIG. 9, the wheels are mounted on laterally projecting collars 42 attached to flanges 40 by bolts 44. Flanged wheels 46, preferably formed of high strength low friction plastic material, are rotatably supported by the collars where their running surfaces will ride on the lower interior flanges of the guide channels 2. The carriage assembly 8 is thereby supported on the base plate 4, and guided for movement in a horizontal linear path by the guide members 2.

The intermediate carriage portion 36, best shown in FIG. 7, is supported by and pivoted on the lower carriage portion 34 by means of a bearing disc 48 of low friction high strength plastic and a shoulder bolt 50 which provides the pivotal interconnection. The intermediate carriage 36 has a pair of upstanding flanges 52 which support flanged wheels 54 by means substantially similar to those illustrated in FIG. 9.

The upper carriage portion 38 includes a horizontal plate 56 which carries an upright cradle 15 which-,together with the tilting cradle 20 discussed above, supports the boot assembly 8. A pair of channels 60 depend from the plate 56 and face inwardly to receive the guide wheels 54 of the intermediate carriage portion 36 as shown in FIG. 7. This structure, coupled with the ability of the intermediate carriage portion 36 to pivot about a vertical axis, provides the horizontal plate 56 and the boot assembly connected thereto with a high degree of mobility.

For certain exercises, it is desirable to limit or stop the longitudinal travel of the carriage 8. To achieve this, the apparatus includes the movable stops 62 shown in FIGS. 1, 2, and 10. These stops 62 lie in the path of carriage travel and fit the guide members 2 as shown in FIG. 10. When the stops 62 are positioned at the desired extreme positions of carriage travel, they are locked in position by tightening the thumb screws 64. Complete removal of the stops 62 and carriage 6 from the guide members 2 is prevented by the vertical stop posts 66 which are held in place by an upwardly-extending bolt and are removable to permit maintenance and assembly of the apparatus.

For some reasons, it is desirable to make movement of the carriage more difficult by imposing a resistance force thereon which must be overcome to move the carriage. In the preferred embodiment, this resistance force is provided by an adjustable drag mechanism illustrated in FIG. 7. This adjustable drag mechanism includes a pair of members 68 and 70 which are supported in the lower carriage portion 34 and biased outwardly so their end surfaces frictionally contact the guide members 2. Both members 68 and 70 are supported and guided for transverse movement by apertures in the depending flanges 40 and by a bored support block 72 attached to the lower carriage portion. The confronting ends of the members 68 and 70 are counterbored to receive a helical compression spring 74. The force exerted by the spring 74, and the resulting frictional drag force imposed by members 68 and 70 on the carriage assembly 6, is adjustable by means of a grub screw 76, the interior end of which bears on a disc 78 engaged with the spring 74. To adjust the drag force exerted by the drag mechanism, the carriage is moved to the position shown in FIG. 6 where the screw 76 is accessible through an opening 80 in the guide 2. A screw driver is inserted through the opening 80, engaged with the screw 76 and is rotated to increase or decrease the compression of spring 74. Clockwise rotation will compress the spring causing the members 68 and 70 to impose an increased drag force to resist carriage movement. To prevent the drag member 70 from rotating with the screw 76 during such adjustment steps, the member 70 is provided with a pin 82 which is located in a narrow transverse guide slot 84 in block 72.

The details of the boot assembly are best illustrated in FIGS. 3, 4 and 5. Preferably, the boot assembly is constructed so the heel area is cut out to prevent heel decubiti, and the dorsum of the foot is exposed for visual observation of post-operative complications. As previously mentioned, the boot includes a leg-receiving member 10 for engaging the lower leg of a patient and a sole member 12 which engages a patient's sole. As shown best in FIG. 1, pairs of cooperating brackets are connected to each side of the boot assembly. On the right side of the boot shown in FIG. 3, the brackets 86 and 88 are hingedly connected by a hinge which has a hinge pin 90. These brackets carry a locking mechanism which prevents the pivotal movement of the sole member 12 relative to the leg-receiving member 10. The left side of the boot is shown in FIGS. 1 and 5 and includes brackets 92 and 94 pivotally connected together by a hinge pin 96. A cycle counter mechanism is provided on these brackets as will be described below. Both pairs of brackets include means for exerting a resistance force on the sole member to resist but not prevent pivotal movement of the sole member 12 relative to the leg-receiving member 10. Preferably this resistance force is exerted by adjustable tension springs on both sides of the boot assembly. FIG. 3 shows a spring 97 which is adjustably tensioned between a lateral flange 98 on bracket 86 and a lateral flange 100 on bracket 88. The opposite ends of the spring are engaged in transverse holes in threaded rods 102 and 104 which extend respectively through the flanges 98 and 100. Rod 104 is threadedly engaged in flange 100 and held against rotation by a lock nut 106. The rod 102 is axially movable in a hole in flange 98. A knurled nut 108 threaded on rod 102 bears against the flange 98 and may be rotated to change the axial position of rod 102. Of course, such a change will vary the tension in spring to change the resistance of sole member 12 to pivotal movement. An identical spring arrangement is located on the opposite side of the boot as shown in FIGS. 1 and 5.

For certain exercises, the sole member 12 should not pivot relative to the leg-receiving member 10. Accordingly, the preferred apparatus is provided with a disengageable lock means for preventing such pivotal movement. This lock means is shown in FIGS. 3 and 4 and includes a block 110 stationarily connected to bracket 86. A block 112 on the bracket 88 is slidably mounted to permit it to move from the engaged position shown in FIG. 3 to the disengaged position shown in FIG. 4. In FIG. 3 a projecting portion of block 112 overlies part of block 110 to prevent pivotal movement between the brackets 86 and 88 and between their respective boot components. When in either position, the block 112 may be held against sliding movement by tightening a thumb nut 114 which is threaded on a rod which extends downwardly from block 112.

The primary purpose of the pivotal connections between the leg-receiving member 10 and sole member 12 of the boot 8 is to permit a patient to move his ankle during soleus pumping exercises. The number of ankle movements is indicative of the exercise received, so it is desirable to provide the apparatus with a cycle counter capable of informing a therapist or the patient of the extent of exercise achieved. The cycle counter is shown at 116 in FIG. 5 where it is stationarily affixed to the bracket 94. The counter 116 has an actuator 118 which, when depressed, operates an internal counter mechanism with an odometor-like readout. To actuate the counter, a presser member 120 is supported on a post 122 on bracket 92. The presser 120 is connected to the post 122 by bolts 124 which extend through an elongated slot on the presser. This connection permits fine tuning of the apparatus to ensure that the presser will depress the actuator 118 when the sole member 12 moves to the upright position shown in FIG. 5, thereby recording that another cycle has been performed.

The apparatus of this invention may be set up on many ways to enable a therapist to provide a patient with different exercises. For a soleus pumping exercise in which the ankle joint is moved and the sole member 12 pivoted relative to the leg-receiving member 10, the leg-receiving member extends transversely to the guide members 2 as shown in FIG. 2. Preferably, the stops 62 are moved inwardly to prevent movement of the carriage along the guide members 2. When the springs 97 are properly tensioned to provide an appropriate resistance force, and the locking block 112 is placed in its disengaged position as shown in FIG. 4, the patient, while seated with his leg extended, presses with his sole to move the sole member 12 from its upright vertical position to the inclined position shown in FIG. 4. When the patient relaxes, the springs 97 return the sole member to the upright position and presser 120 actuates the counter mechanism 116 to indicate that another cycle has been performed.

For the other exercises performed in the apparatus, it is desirable to lock the sole member 12 against pivotal movement relative to the leg-receiving member 10. As previously mentioned, this is achieved by sliding the locking block 112 to its locking position as shown in FIG. 3, and tightening thumb nut 114 to retain it in position.

During hip abduction and adduction exercises, the seated patient extends his leg generally horizontally and moves his foot in a horizontal arcuate path. For such exercises, the apparatus is set up as shown in FIG. 2 in which the arcuate path of movement of the boot is indicated by the arrow 126. This movement includes longitudinal components permitted by the lower carriage portion and transverse components permitted by the connection between the intermediate and upper carriage portions. The pivotal connection between the lower and intermediate carriage portions enables the boot 8 to swing so its leg-receiving portion remains aligned with the patient's hip joint. The extent of hip movement is a significant measure of the patient's recovery, so the base plate 4 is provided with a series of markers 128 which preferbly are associated with numerical indicia to indicate the degree of movement. In situations where the hip movement should be limited, the stop members 62 are appropriately positioned and held in place.

A third type of exercise which may be performed with the apparatus is a knee flexion exercise. It is done with the apparatus set up as shown in FIG. 1. Unlike the two preceding exercises, the boot 8 is freed to move pivotally by disengaging the thumbscrew 32 from the eye 28 on the boot. The leg-receiving portion of the boot is longitudinally aligned with the guide members 2 and the patient sits at the end of the base plate 4. The exercise is performed by bending the knee, causing the carriage to move longitudinally as indicated by arrow 130 while the boot assembly 8 pivots relative to the carriage on pin 14. If desired, the extent of carriage travel movement may be controlled by appropriate positioning of the stop members 62.

In addition to the active exercises mentioned, this apparatus is also useful for static abduction therapy. For such treatment which usually is administered after surgery, the foot is placed in the boot 8, the lower extremity is moved to the desired degree of abduction, and the stops 62 are positioned and locked against the opposite sides of the carriage 6.

From the foregoing, it will be appreciated that this invention represents an extremely uncomplicated but versatile therapeutic apparatus. It is lightweight, portable and easily carried by the handle. Persons familiar with this art will realize that this device may be modified in many ways while still embracing one or more of its basic concepts. Accordingly, it is emphasized that the invention is not limited only to the disclosed embodiment but encompasses a wide variety of devices which differ therefrom but fall within the spirit of the following claims.

I claim:

1. Therapeutic exercising apparatus comprising,
elongated guide means,
a carriage assembly engaged with and guided by said elongated guide means,
a boot assembly supported on said carriage assembly, said boot assembly including a leg receiving member for engaging the lower leg of a patient and a sole member for engaging the sole of a patient's foot, said sole member being movable relative to said leg receiving member about a substantially horizontal pivot axis, said boot assembly being movable in a substantially horizontal linear path and in a substantially horizontal arcuate path.

2. The apparatus of claim 1 including pivot means which enables the boot assembly to swing horizontally about a substantially vertical axis.

3. The apparatus of claim 2 wherein the boot assembly is movable from a first position where it is oriented longitudinally of the guide means for knee flexion and extension exercises, to a second position where it is oriented transversely of the guide means for hip abduction and adduction exercises.

4. The apparatus of claim 2 wherein said boot assembly is connected to said carriage assembly for movement about a horizontal pivot axis to permit knee flexion and extension exercises during movement of the carriage.

5. The apparatus of claim 4 including lock means for preventing said boot assembly from moving relative to said carriage assembly about said horizontal pivot axis.

6. The apparatus of claim 4 wherein the boot assembly is movable from a first position where it is oriented longitudinally of the guide means for knee flexion and extension exercises, to a second position where it is oriented transversely of the guide means for hip abduction and adduction exercises.

7. The apparatus of claim 1 wherein said boot assembly is connected to said carriage assembly for movement about a horizontal pivot axis to permit knee flexion and extension exercises during movement of the carriage.

8. The apparatus of claim 7 including lock means for preventing said boot assembly from moving relative to said carriage assembly about said horizontal pivot axis.

9. The apparatus of claim 1 wherein the boot assembly is movable from a first position where it is oriented longitudinally of the guide means for knee flexion and extension exercises, to a second position where it is oriented transversely of the guide means for hip abduction and adduction exercises.

10. The apparatus of claim 1 wherein said apparatus includes means for limiting the range of movement of the carriage assembly along the guide means.

11. The apparatus of claim 1 including disengageable lock means for preventing pivotal movement of said sole member relative to said leg-receiving member.

12. The apparatus of claim 1 including counter means for counting and displaying the movements of said sole member relative to said leg-receiving member.

13. The apparatus of claim 1 including means for exerting a resistance force on the carriage to resist but not prevent movement of the carriage assembly along the guide means.

14. The apparatus of claim 13 wherein the means for exerting a resistance force includes a drag member supported on the carriage, a spring for biasing the drag member to an extended position, and means for adjusting the force exerted on the drag member by the spring.

15. The apparatus of claim 1 wherein the carriage assembly includes a lower carriage portion engaged with the elongated guide means and movable therealong, and an upper carriage portion movable in a direction which is transverse to the elongated guide means, means connecting the lower carriage portion to the upper carriage portion, said boot assembly being connected to and supported by said upper carriage portion.

16. The apparatus of claim 15 wherein the means connecting the upper carriage portion to the lower carriage portion includes an intermediate carriage portion which is pivotally connected to the lower carriage portion for movement about a substantially vertical pivot axis.

17. The apparatus of claim 1 including means for exerting a resistance force on the sole member to resist but not prevent movement of the sole member relative to said legreceiving member.

18. The apparatus of claim 17 wherein the means for exerting a resistance force is a spring which biases the sole member to a position which is oriented at about 90° to said leg-receiving member.

19. Therapeutic exercising apparatus comprising,
elongated guide means,
a carriage assembly engaged with and guided by said elongated guide means,
a boot assembly supported on said carriage assembly, said boot assembly including a leg receiving member for engaging the lower leg of a patient and a sole member for engaging the sole of a patient's foot, pivot means which enables the boot assembly to swing horizontally about a substantially vertical axis, said boot assembly being movable in a substantially horizontal linear path and in a substantially horizontal arcuate path.

20. Therapeutic exercising apparatus comprising,
elongated guide means,
a carriage assembly engaged with and guided by said elongated guide means,
a boot assembly supported on said carriage assembly, said boot assembly including a leg receiving member for engaging the lower leg of a patient and a sole member for engaging the sole of a patient's foot, pivot means which enables the boot assembly to tilt about a substantially horizontal axis, said boot assembly being movable in a substantially horizontal linear path and in a substantially horizontal arcuate path.

* * * * *